United States Patent [19]

Myers

[11] Patent Number: 4,787,277

[45] Date of Patent: Nov. 29, 1988

[54] SLIDING RATCHET WRENCH

[76] Inventor: Robert E. Myers, 18507 Prince William La., Houston, Tex. 77058

[21] Appl. No.: 55,093

[22] Filed: May 29, 1987

[51] Int. Cl.[4] ..... B25B 1/12

[52] U.S. Cl. ..... 81/179; 81/126

[58] Field of Search ..... 81/179, 126–129, 81/185.1, 186

[56] References Cited

U.S. PATENT DOCUMENTS

| | | | |
|---|---|---|---|
| 3,198,041 | 8/1965 | Davis | 81/179 X |
| 3,306,142 | 2/1967 | Buteau | 81/179 |
| 4,437,364 | 3/1984 | Martinmaas | 81/179 |

*Primary Examiner*—Debra Meislin

*Attorney, Agent, or Firm*—Sughrue, Mion, Zinn, Macpeak and Seas

[57] ABSTRACT

The headed end of a wrench body of elongated rectangular form includes a first stationary jaw defining a first gripping surface. A slide mount foot projects from the body opposite the stationary jaw, and is spaced therefrom. It includes a flat bearing surface. A slidable jaw shoe mounts on the foot, and is slidable towards and away from the wrench body headed end. The shoe has a bite portion forming a second gripping surface which extends parallel to the stationary jaw first gripping surface and faces the same. A straight wire spring has one end fixed within a V-shaped groove which diverges from the stationary jaw within the side of the wrench body towards the foot with the straight wire spring having a free end fitting with an oblique slot within a sliding jaw shoe, permitting the slidable jaw shoe to move in opposition to the bias to ratchet the wrench about a nut or bolt head captured between the first and second gripping surfaces when rotating the wrench body in a first direction. During rotation of the wrench body in an opposite direction, the first and second gripping surfaces grip opposite parallel flats on the nut or bolt head to force the nut or bolt head to rotate with the wrench body.

3 Claims, 1 Drawing Sheet

SLIDING RATCHET WRENCH

FIELD OF THE INVENTION

This invention relates to open end wrenches and more particularly to a sliding ratchet wrench of simplified form which allows a ready substitution of replaceable sliding jaws for a different size nut.

BACKGROUND OF THE INVENTION

Open ended wrenches have been constructed of the sliding or pivoting ratchet type whereby, through the use of moveable jaw, the wrench will ratchet in one direction while locking in the opposite direction.

While the many different types of moveable jaw ratchet wrenches have been designed, such wrenches have moving parts which are subject to heavy wear, and which lack replaceability of one moveable jaw with another replacement moveable jaw, sized to a different nut diameter.

It is therefore a primary object of the invention to provide an open end sliding ratchet wrench which supports a slidable jaw capable of ready and quick replacement, which utilizes a minimum number of parts, which easily ratchets in a first direction but ensures lockability in a opposite direction of wrench rotation about the axis of a nut or bolt engaged therewith, and which is easily and cheaply constructed.

DESCRIPTION OF THE PREFERRED EMBODIMENT

Figure 1:
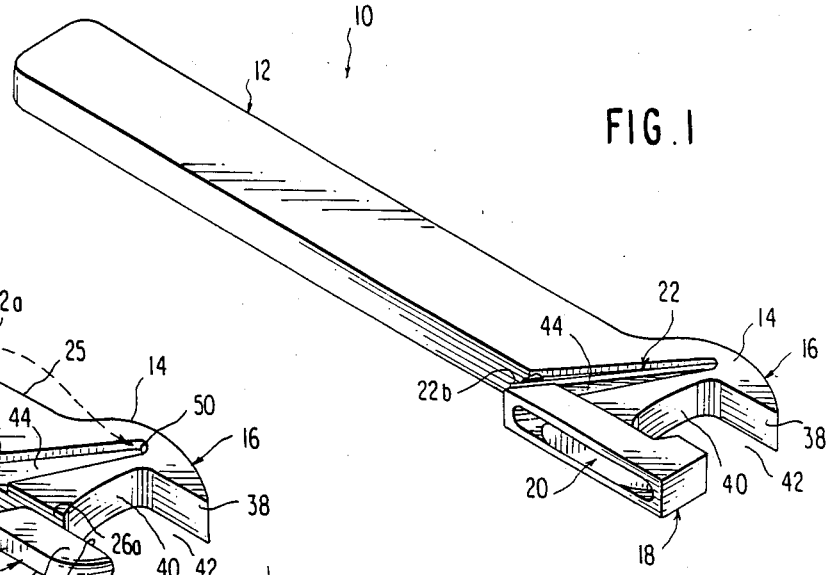
FIG. 1 is a perspective view of the sliding ratchet wrench forming a preferred embodiment of the invention.
Figure 2:
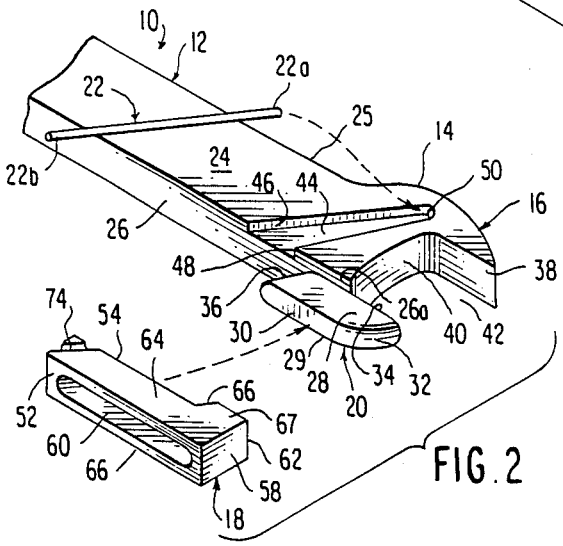
FIG. 2 is an exploded, perspective view of the three components making up the sliding ratchet wrench of FIG. 1.

Referring to the drawings, the sliding ratchet wrench forming a preferred embodiment is indicated generally at 10 and consists of three basic elements, an elongated handle or body 12, a slidable jaw 18 and a wire spring 22 fixed at one end to the handle or body 12 and engaging the slideable jaw to bias the slidable jaw rearwardly thereof. The handle or body 12 is of elongated generally rectangular form having opposed side faces 24 and opposite, top and bottom edges 25, 26. One end of the handle or body 12 terminates in a enlarged head 14 which includes a frontal slot 42 terminating in a transverse and end face 40 and a right angle, first gripping surface 38 partially defining a stationary jaw indicated generally at 16. Within the side face 24 of the handle or body 12 there is provided, at the juncture between head 14 with the balance of the handle or body 12, a diverging groove 44 which is oblique, to the longitudinal axis and which extends outwardly to one side 26 remote from the stationary jaw 16. Groove 44 forms oppositely oblique right angle faces or walls 46, 48 which function as stops for the spring wire 22. The spring wire 22 has one end **22*a* fixed to the handle or body 24 within the head 14 at the apex 50 of the V-shaped groove 44 while its opposite free end 22*b* extends beyond the bottom edge 26 of the handle or body 12. Projecting outwardly of the bottom 26 of the handle or body 12 is a slide mount or foot, indicated generally at 20 which is machined from a metal block including handle or body 12 and head 14, but whose thickness is less than that of the handle of body 12. Therefore foot 20 defines pair of opposite side guide surfaces 26*a* for the slidable jaw or shoe 18 which is mounted thereon. The slide mount 20, has opposite side surfaces 28, 29, a bottom edge or face 30, an arcuate front surface 32 and an oblique angle rear surface 36, along with a vertical flat bearing surface 34, parallel to and facing the first gripping surface 38 of the stationary jaw 16**.

The slidable jaw, or shoe indicated generally at 18 takes the form of a rectangular elongated block including a bottom face 52, a top face 54, a front end face 58, a rear and end face 56, and opposite side faces 64 and 65. Further, the slidable jaw or shoe 18 includes an elongated central slot 60 which extends fully from the bottom face 52 to the top face 54. In machining the slidable jaw or shoe 18, a flat, byte portion or lip 67 is formed within the slidable jaw 18, projecting beyond the top face 54 and from the front end face 58 towards the rear end face having a flat outer face 62, which functions as a second gripping surface, facing the first gripping surface 38 of stationary jaw 16. Further, the lip 67 terminates in an oblique camming face 66 which performs the function of causing ratcheting of the wrench 10 when the handle or body 12 rotates about a nut 78 as for instance, in FIG. 4 in a clockwise direction. When handle 12 is rotated in a counter-clockwise direction 86 with the wrench 10 flipped over as per FIG. 6 ratcheting occurs. Further, an oblique groove 74 is formed within the side surface 64 of the slidable jaw 18, within which is positioned the free end **22*b* of the wire spring 22 to bias the slidable jaw 18 rearwardly relative to the handle or body 12 upon which it is slidably mounted, via the slide mount or foot 20**.

Figure 3:
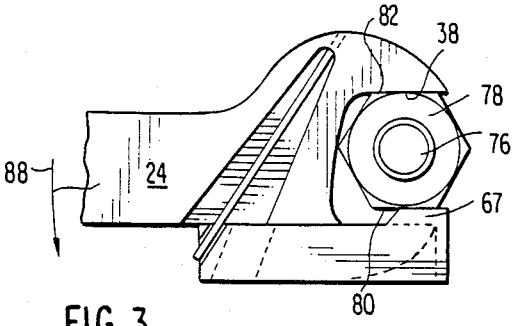
FIG. 3 is a side view of the wrench under conditions of full grip with a nut threaded to a bolt under non-ratchet conditions.

Further, with respect to the slot 60 within the slide mount 18, the slot 60 forms a right angle end surface 70 extending to the inner surface 68 of the byte portion or lip 67. At the opposite longitudinal end of the slot 60, within the slidable jaw 18, the slot 60 terminates in a oblique end wall or surface 72. Wire spring 22 is relatively stiff. At the apex end of the groove, body 12 may be peened over to mechanically lock the end **22*a* of the wire spring to the handle or body 12 at apex 50. Further, the wire spring 22 should lie proximate to the groove vertical wall 46, remote from the front end face 42 of the ratchet wrench 10 thus tending to the bias the slidable jaw 18 towards the rear as per FIG. 1. Further, the axial length of slot 60. FIG. 3 at the top face 54 of the slidable jaw or shoe 18 is approximately equal to the length of the slide mount or foot 20 so that with the wire spring 22 disengaged, the slide mount or foot 20 can be inserted into slot 60 of shoe 18 through top face 54 of the slidable jaw. Thereafter, the bearing surface 34 of the foot 20 at the front edge 32 of that member slides under the byte portion or lip 67 and contacts the inner surface 68 of that byte portion, while the top face 54 of the slidable jaw contacts co-planar guide surfaces 26a, to opposite sides of the integral slide mount or foot 20**.

The free end 22b of the wire spring 22 may be deflected momentarily upwardly, and flipped over the side face 64 of the shoe 18, into the oblique slot 74 within the rear end of the slidable jaw or shoe 18, so as to be locked therein to bias the slidable jaw rearwardly on handle 12. The sliding ratchet wrench then is fully assembled and ready to function as a sliding ratchet wrench.

In that respect, the wrench in operation is shown under various grip and ratchet conditions in the FIGS. 3-6, inclusive. Looking first to FIG. 3, the sliding ratchet wrench 10, in side view, has the first gripping surface 38 in contact with a flat 82 of a hex nut 78 which is threaded to the end of a threaded shank 76 of a bolt. The opposite flat 80 of the hexagonal nut 78, is in contact with the flat face of byte portion or lip 67. The distance between the byte portion 67, which forms a second gripping surface 62 to the first gripping surface 38 of the stationary jaw, is equal to the width of the nut 78 thus, when the handle 24 is rotated counter-clockwise as per arrow 88, the wrench 10 acts positively to rotate the nut 78 relative to the bolt threaded shank 76.

Figure 4:
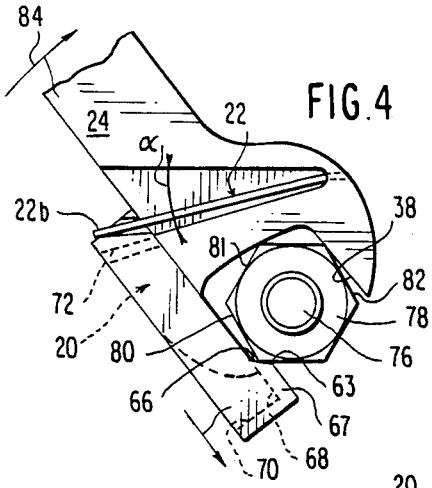
FIG. 4 is a side view of the wrench in operation as per FIG. 3 with the handle rotated in the opposite direction and ratcheting with respect to the nut.

Turning next to FIG. 4, with the set-up identical, but with the handle 12 rotated clockwise as indicated by arrow 84, the clockwise rotation of the sliding ratchet wrench handle or body 12 causes the first gripping surface 38 of the stationary jaw 16 to cock relative to the flat end 82 of nut 78. Simultaneously, the opposite flat 80 of the nut 78 rolls over edge 63 so that a portion of the flat 80 contacts the oblique camming surface 66. This action causes the spring biased slidable jaw 18 to be driven relative from left to right Figure 4, against the bias spring 22 in the direction of arrow 90, until the flat 80 rides fully across the cam face 66 whereupon, the bias of the wire spring 22 causes the slidable jaw 18 to snap back to the position shown in FIG. 3 with the next flat 81 contacting the byte portion 67. A repetitive sliding ratchet process occurs as long as the sliding ratchet wrench handle 12 is rotated clockwise under the conditions of FIG. 4.

Figure 5:
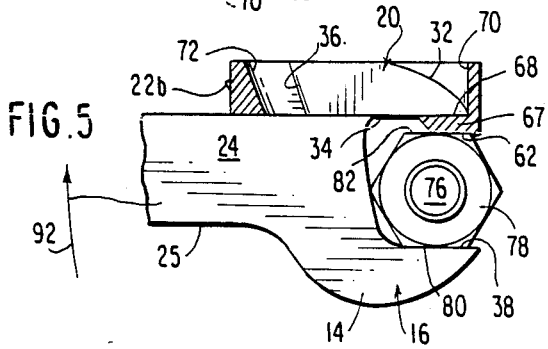
FIG. 5 is a side view of the wrench, as flipped over and rotated clockwise under wrench grip conditions.
Figure 6:
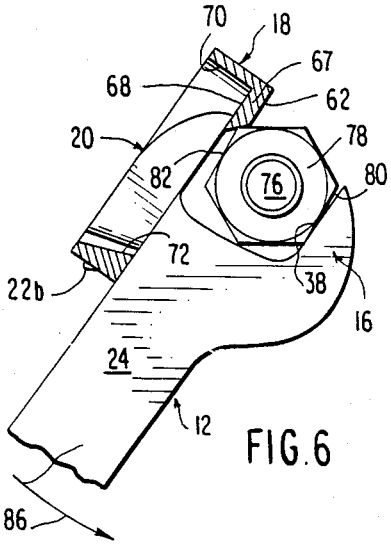
FIG. 6 is a side view of the wrench and nut set-up of FIG. 5 with the wrench end rotated in the opposite direction under ratchet, slip conditions.

The same is true if the sliding ratchet wrench is flipped over as evidenced in FIGS. 5 and 6. In FIG. 5, with the handle 12 flipped over, the first gripping surface 38 of the stationary jaw 16 is in contact with flat 80 of nut 78 while, the opposite flat 82 of the nut is in flush surface contact with the second gripping surface 62 of the byte portion 67 of the slidable jaw 18. Under those conditions, there is a full grip of nut 78 causing the nut to also rotate in a clockwise direction relative to the threaded bolt shank 76 in response to clockwise rotation of the wrench handle 12 as indicated by arrow 92.

In contrast in FIG. 6, with the sliding ratchet wrench 10 in the position of FIG. 5 and, with the handle or body 12 rotated counter-clockwise as per arrow 86, a slip or ratcheting action occurs with the wrench rotating about the axis of the bolt shank 76 on nut 78 from flat to flat in accordance with the description above with respect to FIG. 4, and with the slidable jaw 18 oscillating back and forth against the bias of wire spring 22 to permit that action.

As may be appreciated, the sliding ratchet wrench 10 is formed of three individual components, the handle or body 12, the slidable jaw 18 and the wire spring 22. The wire spring 22 is highly effective, having limited movement due to its placement within the diverging groove 44 with the wire deflection limited to the angle $\alpha$, FIG. 4 defined by right angle laterally opposed oblique side walls 46, 48 forming positive stops for the wire. In a practical sense, the front and rear edges 32, 36 of the slide mount limits oscillation of the slidable jaw 18 by contacting interiorly of slot 60, opposed end walls 70, 72 respectively of that member.

Further, while not shown, the slidable jaw 18 may be replaced by substitute slidable jaws having a lip or byte portion 67 which projects further away from or closer to the right angle top face 54 of the slidable jaw 18, such that the second gripping surface 62 thereof is further away or spaced closer to the first gripping surface 38 of stationary jaw 16. This provides a wrench accepting a different size (smaller) or larger nut than nut 78, or a corresponding sized bolt head. The replacement of slidable jaws 18 is easily accomplished merely by flipping the free end 22b of the wire spring upwardly and out of the oblique slot 74 of a shoe 18 and tipping the slidable jaw or shoe 18 so that it frees itself via slot 60 from the slide mount or foot 20 upon which it is mounted via the bearing surface 34 for oscillation parallel to the longitudinal axis of the sliding ratchet handle or body 12. Surfaces 26a of the handle 12 form reaction surfaces for shoe 20 during wrench operation to absorb torque developed during wrenching. The opposite end of the wrench from head 14 may be similarly formed and carry a shoe 18 to form a double ended ratchet wrench.

The foregoing is considered as illustrative only of the principles of the invention as applied to a preferred embodiment. Further since numerous modifications and changes will readily occur to those skilled in the art, it is not desired to limit the invention to the exact construction and operation shown and described, and accordingly all suitable modifications and equivalents may be restored to, falling within the scope of the invention as claimed.

What is claimed is:

1. A sliding ratchet wrench comprising:

a wrench body terminating at one end in a head, said head including a first stationary jaw defining a first gripping surface, a slide mount projecting from said body opposite from said stationary jaw, being spaced therefrom and defining a flat bearing surface facing said stationary jaw, a slidable jaw mounted on said slide mount and slidable towards and away from said wrench body and having a byte portion forming a second gripping surface which extends generally parallel to said stationary jaw first gripping surface facing that first gripping surface and being spaced therefrom to grip opposite flats of a nut or bolt head therebetween, said slidable jaw byte portion including an inner surface slidably mating with said slide mount bearing surface and an adjacent slide surface contacting said wrench body to resist torque acting on said sliding jaw at said byte portion in response to wrench operation, said wrench further including spring means biasing said slidable jaw in a retracted position toward said wrench body to align said first and second gripping surfaces with each other and said slidable jaw further including a cam surface rearward of the byte portion second gripping surface and disposed at an angle thereto to cause said slidable jaw to move in opposite to said bias to effect ratcheting of said wrench about a nut or bolt head captured between said first and second gripping surfaces when rotating said wrench body in a first direction relative to the axis of said nut or bolt head, and wherein, during the rotation of said wrench body in a second direction, said first and second gripping surfaces grip opposite, parallel flats on said nut or bolt head to force said nut or bolt head to rotate with said wrench body and wherein a side face of the wrench body perpendicular to said first gripping surface of said stationary jaw includes an elongated groove extending from the side of said ratchet wrench remote from said slide mount to the side of said wrench body proximate to said slide mount, said groove diverging in the direction of said slide mount, said biasing means comprises a straight wire spring having one end fixed to the apex end of said diverging groove, said slidable jaw including a diagonal groove within a face thereof aligned with said wrench body diverging groove, said straight wire spring including a free end positioned within said slidable jaw groove, and wherein the position of said wire spring is such that said wire spring exerts a biasing force tending to contact the side wall of said diverging groove remote from said stationary jaw to bias said slidable jaw in a retracted position, and wherein said diverging groove limits the flexing of said spring in a fore and aft position relative to the stationary jaw.

2. A sliding ratchet wrench comprising:

a wrench body terminating at one end in a head, said head including a first stationary jaw defining a first gripping surface, a slide mount projecting from said body opposite from said stationary jaw, being spaced therefrom and defining a flat bearing surface facing said stationary jaw, a slidable jaw mounted on said slide mount and slidable towards and away from said wrench body and having a byte portion forming a second gripping surface which extends generally parallel to said stationary jaw first gripping surface facing that first gripping surface and being spaced therefrom to grip opposite flats of a nut or bolt head therebetween, said slidable jaw byte portion including an inner surface slidably mating with said slide mount bearing surface and an adjacent slide surface contacting said wrench body to resist torque acting on said sliding jaw at said byte portion in response to wrench operation, said wrench further including spring means biasing said slidable jaw in a retracted position toward said wrench body to align said first and second gripping surfaces with each other and said slidable jaw further including a cam surface rearward of the byte portion second gripping surface and disposed at an angle thereto to cause said slidable jaw to move in opposition to said bias to effect ratcheting of said wrench about a nut or bolt head captured between said first and second gripping surfaces when rotating said wrench body in a first direction relative to the axis of said nut or bolt head, and wherein, during the rotation of said wrench body in a second direction, said first and second gripping surfaces grip opposite, parallel flats on said nut or bolt head to force said nut or bolt head to rotate with said wrench body, and wherein said slide mount is integral with said sliding ratchet wrench body and projects outwardly from the bottom of said wrench body, being of a thickness which is less than the thickness of said wrench body and being laterally centered thereon to form flat parallel guide surfaces on opposite sides of said slide mount, said slide mount being of generally rectangular form with said bearing surface being a flat surface parallel to said first gripping surface formed by said stationary jaw, said slidable jaw is of elongated block form having a flat slide face proximate to said wrench body and said slidable jaw having an elongated slot extending therethrough, said slot being closed at opposite front and rear ends, and wherein said slidable jaw further includes a lip projecting from a forward end thereof overlying said slot and defining said byte portion and having a flat inner surface in contact with the flat bearing surface of said slide mount and wherein the length of the slide mount is on the order of the length of said slot within said slidable jaw such that, said slidable jaw may be fitted onto the slide mount by inserting the slide mount fully into said elongated slot of said slidable jaw with a front edge of the slide mount positioned beneath said lip and wherein, said spring biasing means causes the front end of the slidable jaw to be maintained in contact with the front surface of said slide mount and wherein the outer surface of said lip, defines said byte forming said second gripping surface, and the end of said lip remote from the front face thereof forms said camming surface.

3. A sliding ratchet wrench comprising:

a wrench body terminating at one end in a head, said head including a first stationary jaw defining a first gripping surface, a slide mount projecting from said body opposite from said stationary jaw, being spaced therefrom and defining a flat bearing surface facing said stationary jaw, a slidable jaw mounted on said slide mount and slidable towards and away from said wrench body and having a byte portion forming a second gripping surface which extends generally parallel to said stationary jaw first gripping surface facing that first gripping surface and being spaced therefrom to grip opposite flats of a nut or bolt head therebetween, said slidable jaw byte portion including an inner surface slidably mating with said slide mount bearing surface and an adjacent slide surface contacting said wrench body to resist torque acting on said sliding jaw at said byte portion in response to wrench operation, said wrench further including spring means biasing said slidable jaw in a retracted position toward said wrench body to align said first and second gripping surfaces with each other and said slidable jaw further including a cam surface rearward of the byte portion second gripping surface and disposed at an angle thereto to cause said slidable jaw to move in opposition to said bias to effect ratcheting of said wrench about a nut or bolt head captured between said first and second gripping surfaces when rotating said wrench body in a first direction relative to the axis of said nut or bolt head, and wherein, during the rotation of said wrench body in a second direction, said first and second gripping surfaces grip opposite, parallel flats on said nut or bolt head to force said nut or bolt head to rotate with said wrench body and wherein a side face of the wrench body perpendicular to said first gripping surface of said stationary jaw includes an elongated groove extending from the side of said ratchet wrench remote from said slide mount to the side of said wrench body proximate to said slide mount, said groove diverging in the direction of said slide mount, said slide mount is integral with said sliding ratchet wrench body and projects outwardly from the bottom of said wrench body, being of a thickness which is less than the thickness of said wrench body and being laterally centered thereon to form flat parallel guide surfaces on opposite sides of said slide mount, said slide mount being of generally rectangular form with said bearing surface being a flat surface parallel to said first gripping surface formed by the stationary jaw, said slidable jaw is of elongated block form having a flat side face proximate to said wrench body and an elongated slot extending therethrough, said slot being closed at opposite ends, said slidable jaw further including a lip projecting from a forward end thereof overlying said slot and defining said byte portion and having a flat inner surface in contact with the flat bearing surface of said slide mount, and wherein the length of the slide mount is on the order of the length of the slot within said slidable jaw such that said slidable jaw may be fitted onto the slide mount by inserting the slide mount into said elongated slot of said slidable jaw with a front edge of the slide mount positioned beneath said lip, said biasing means comprises a straight wire spring having one end fixed to the apex end of said diverging groove, said slidable jaw including a diagonal groove within a face thereof aligned with said wrench body diverging groove, said straight wire spring including a free end positioned within said slidable jaw groove, and wherein the position of said wire spring is such that said wire spring exerts a biasing force tending to contact the side wall of said diverging groove remote from said stationary jaw to bias said slidable jaw in a retracted position, and wherein the outer surface of said lip defines said byte forming said second gripping surface, and the end of said lip remote from said front face thereof forms said camming surface.

* * * * *